US009083155B2

(12) United States Patent
Yoshizaki et al.

(10) Patent No.: US 9,083,155 B2
(45) Date of Patent: Jul. 14, 2015

(54) SPARK PLUG WITH AN IMPROVED SEPARATION RESISTANCE OF A NOBLE METAL TIP

(71) Applicant: NGK SPARK PLUG CO., LTD., Nagoya (JP)

(72) Inventors: Hirotoshi Yoshizaki, Nagoya (JP); Tomoyuki Igarashi, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/011,215

(22) Filed: Aug. 27, 2013

(65) Prior Publication Data

US 2014/0062284 A1 Mar. 6, 2014

(30) Foreign Application Priority Data

Aug. 30, 2012 (JP) ..... 2012-190277

(51) Int. Cl.

| | |
|---|---|
| ***H01T 13/20*** | (2006.01) |
| ***H01T 13/39*** | (2006.01) |
| ***H01T 13/32*** | (2006.01) |
| ***H01T 21/02*** | (2006.01) |
| ***H01T 21/06*** | (2006.01) |

(52) U.S. Cl.

CPC ..... *H01T 13/39* (2013.01); *H01T 13/32* (2013.01); *H01T 21/02* (2013.01); *H01T 21/06* (2013.01)

(58) Field of Classification Search

USPC ..... 313/141

See application file for complete search history.

(56) References Cited

U.S. PATENT DOCUMENTS

| | | | | |
|---|---|---|---|---|
| 4,700,103 | A | 10/1987 | Yamaguchi et al. | |
| 5,574,329 | A * | 11/1996 | Kagawa | 313/141 |
| 5,856,724 | A * | 1/1999 | Chiu et al. | 313/141 |
| 6,573,641 | B2 * | 6/2003 | Matsutani | 313/141 |
| 6,700,317 | B2 | 3/2004 | Kanao et al. | |
| 8,106,572 | B2 * | 1/2012 | Tanaka et al. | 313/141 |
| 2001/0030495 | A1 | 10/2001 | Kanao et al. | |
| 2006/0238092 | A1 * | 10/2006 | Teramura et al. | 313/141 |

FOREIGN PATENT DOCUMENTS

| | | | |
|---|---|---|---|
| JP | 61-171080 | A | 8/1986 |
| JP | 05-275157 | A | 10/1993 |
| JP | 2001-284012 | A | 10/2001 |
| JP | 2004-079507 | A | 3/2004 |

OTHER PUBLICATIONS

Office Action mailed Jul. 29, 2014 for the corresponding Japanese Application No. 2012-190277.

* cited by examiner

*Primary Examiner* — Sikha Roy
(74) *Attorney, Agent, or Firm* — Leason Ellis LLP

(57) ABSTRACT

A spark plug where a predetermined cross section of a noble metal tip is divided by a vertical line into two half cross sections having a first half cross section and a second half cross section. The first half cross section satisfies h1/t≤0.2 and Rw1/Rt1≥1.03, and the second half cross section satisfies h2/t≤0.2 and Rw2/Rt2≥1.03. At a welding interface, an oxidation scale progresses in a direction away from an axis along side surfaces and changes the progressing direction at the end points so as to progress in a direction toward the axis along bottom surfaces. The progress of the oxidation scale is restrained. Since the noble metal tip is held by an engagement portion of a ground electrode, separation of the noble metal tip from the ground electrode 40 can be restrained.

9 Claims, 6 Drawing Sheets

SPARK PLUG WITH AN IMPROVED SEPARATION RESISTANCE OF A NOBLE METAL TIP

This application claims the benefit of Japanese Patent Application No. 2012-190277, filed Aug. 30, 2012, which is incorporated by reference in its entity herein.

FIELD OF THE INVENTION

The present invention relates to a spark plug.

BACKGROUND OF THE INVENTION

Conventionally, there has been proposed a spark plug which has a ground electrode into which a noble metal tip is embedded such that the noble metal tip projects from the distal end of the base member of the ground electrode. The noble metal tip is joined to the base member of the ground electrode by means of resistance welding. Noble metal tips used for the electrodes of such a spark plug are formed of a noble metal which is more excellent than the electrode base member in terms of durability against spark discharge and oxidation (e.g., platinum, iridium, ruthenium, rhodium, etc.) or an alloy containing such a noble metal as a main component.

PRIOR ART DOCUMENT

Patent Document

[Patent Document 1] Japanese Patent Application Laid-Open (kokai) No. 2001-284012

[Patent Document 2] Japanese Patent Application Laid-Open (kokai) No. 2004-79507

Problem to be Solved by the Invention

The joint interface between the base member of the ground electrode and the noble metal tip may oxidize due to heat generated in an internal combustion engine. Excessive oxidation is a cause of separation of the noble metal tip from the base member of the ground electrode. In recent years, the degrees of supercharging and compression of an internal combustion engine have been increased. Therefore, the temperature within a combustion chamber of such an internal combustion engine tends to become higher than that within a combustion chamber of a conventional internal combustion engine. Therefore, the oxidation of the joint interface is accelerated, and the joint strength between the base member of the ground electrode and the noble metal tip decreases, which may increase the possibility that the noble metal tip separates from the electrode base member.

The present invention has been accomplished in order to solve the above-mentioned problem, and its object is to improve the separation resistance of a noble metal tip.

SUMMARY OF THE INVENTION

Means for Solving the Problem

To solve, at least partially, the above problem, the present invention can be embodied in the following modes or application examples.

Application Example 1

A spark plug comprising a center electrode, a ground electrode, and a noble metal tip resistance-welded to at least one of the center electrode and the ground electrode, wherein the noble metal tip has a flat discharge surface, a bottom surface embedded in the electrode to which the noble metal tip is resistance-welded, and a side surface whose width increases from the discharge surface toward the bottom surface;

on a predetermined cross section containing a vertical line passing through the centroid of the discharge surface, a maximum thickness along a direction parallel to the vertical line is defined as the maximum thickness t of the noble metal tip, and a straight line which passes through a portion of the bottom surface where the noble metal tip has the maximum thickness and is parallel to the discharge surface is defined as a first straight line;

on a first half cross section of two half cross sections formed by dividing the predetermined cross section by the vertical line, a maximum width along a direction orthogonal to the vertical line is defined as the maximum width Rw1 of the noble metal tip, a distance between the first straight line and a position where the noble metal tip has the maximum width, the distance being measured along a direction parallel to the vertical line, is defined as a warpage height h1 of the noble metal tip, and a distance from an intersection between the vertical line and the discharge surface to an end portion of the discharge surface is defined as a width Rt1 of the discharge surface;

on a second half cross section of the two half cross sections which differs from the first half cross section, a maximum width along the direction orthogonal to the vertical line is defined as the maximum width Rw2 of the noble metal tip, a distance between the first straight line and a position where the noble metal tip has the maximum width, the distance being measured along the direction parallel to the vertical line, is defined as a warpage height h2 of the noble metal tip, and a distance from an intersection between the vertical line and the discharge surface to an end portion of the discharge surface is defined as a width Rt2 of the discharge surface; and relations $h1/t \leq 0.2$ and $Rw1/Rt1 \geq 1.03$ are satisfied, and relations $h2/t \leq 0.2$ and $Rw2/Rt2 \geq 1.03$ are satisfied.

In general, a welding interface (a diffusion layer formed at the joint interface) between a noble metal tip and an electrode joined together by diffusion bonding achieved by resistance welding oxidizes due to various factors such as an environment of use and use over years. This oxidation of the welding interface is also called oxidation scale. According to the spark plug of the application example 1, the noble metal tip is formed such that, on the first and second half cross sections, which are formed by dividing a cross section of the noble metal tip which passes through the centroid of the discharge surface by a vertical line passing through the centroid, relations $h1/t \leq 0.2$ and $Rw1/Rt1 \geq 1.03$ are satisfied, and relations $h2/t \leq 0.2$ and $Rw2/Rt2 \geq 1.03$ are satisfied. Since the side surface of the noble metal tip is formed to expand away from the axis, oxidation scale progresses in a direction away from the axis along the side surface, and then progresses from the side surface in a direction toward the axis along the bottom surface. When oxidation scale progresses from the side surface to the bottom surface, the progressing direction of oxidation scale changes to an approximately opposite direction, whereby progress of oxidation scale can be restrained, and the separation resistance of the noble metal tip can be improved. Also, according to the spark plug of the application example 1, the noble metal tip is embedded in the electrode such that the cross section has the shape of an inverted wedge. Therefore, the separation resistance of the noble metal tip can be improved further.

Application Example 2

The spark plug described in the application example 1, wherein, on each of the first half cross section and the second half cross section, a distance h3 between the first straight line and the intersection between the vertical line and the bottom surface measured along a direction parallel to the vertical line satisfies relations h3≥h1 and h3≥h2.

According to the spark plug of the application example 2, on each of the first half cross section and the second half cross section, the distance h3 between the first straight line and the intersection between the vertical line and the bottom surface measured along the direction parallel to the vertical line satisfies relations h3≥h1 and h3≥h2. Accordingly, the welding interface between the noble metal tip and the electrode has a portion which is flat or concave toward the discharge surface. Therefore, as compared with the case where the welding interface is convex toward the electrode, the thermal stress acting on the noble metal tip can be reduced, whereby the separation resistance of the noble metal tip can be improved.

Application Example 3

The spark plug described in the application example 1, wherein, on the predetermined cross section, the bottom surface is convex toward the side opposite the discharge surface.

According to the spark plug of the application example 3, the bottom surface of the noble metal tip is convex toward the side opposite the discharge surface. Accordingly, when oxidation scale progresses from the side surface to the bottom surface, the progressing direction of oxidation scale changes to an approximately opposite direction, whereby progress of oxidation scale can be restrained, and the separation resistance of the noble metal tip can be improved.

Application Example 4

The spark plug described in any one of the application examples 1 to 3, wherein the discharge surface has an area of 0.79 $mm^2$ to 3.14 $mm^2$.

According to the spark plug of the application example 4, the area of the discharge surface is equal to or greater than 0.79 $mm^2$. Therefore, an increase in the spark gap between the ground electrode and the center electrode can be restrained. Also, since the area of the discharge surface is equal to or less than 3.14 $mm^2$, the separation resistance can be improved.

Application Example 5

The spark plug described in any one of the application examples 1 to 4, wherein the noble metal tip contains a Pt—Ni alloy, and the electrode to which the noble metal tip is welded contains a nickel alloy containing Cr and Fe.

According to the spark plug of the application example 5, the noble metal tip contains a Pt—Ni alloy, and the electrode to which the noble metal tip is welded contains a nickel alloy containing Cr and Fe. Accordingly, the noble metal tip and the electrode can be welded more easily by resistance welding.

In the present embodiment, the above-described various modes may be properly combined or partially omitted.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying out the Invention

A. First Embodiment

A-1. Structure of Spark Plug

Figure 1:
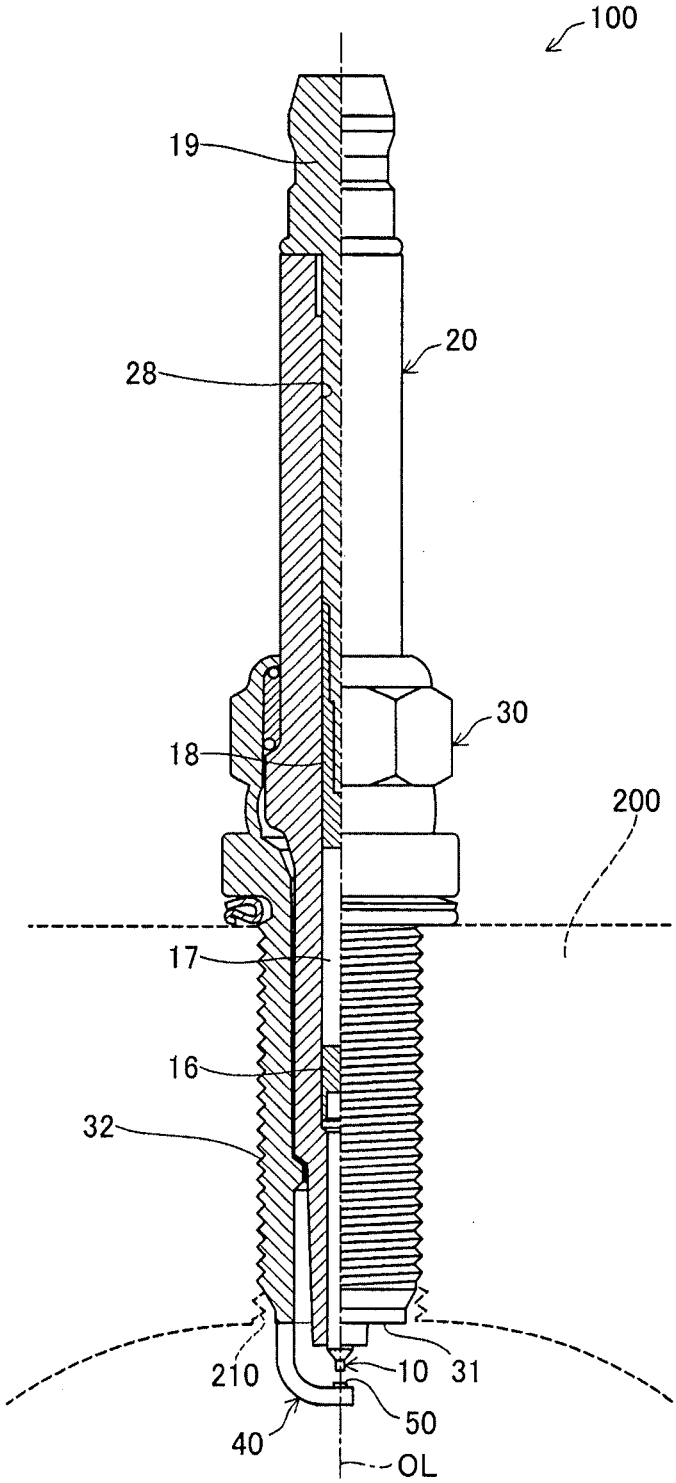
FIG. 1 is a partial cross-sectional view showing a spark plug 100 according to a first embodiment.

FIG. 1 is a partial cross-sectional view showing a spark plug 100. In FIG. 1, the external shape of the spark plug 100 is illustrated on one side of a center axis OL of the spark plug 100 (on the right side of the sheet), and the cross-sectional shape of the spark plug 100 is illustrated on the other side thereof (on the left side of the sheet). In the following description, the lower side of the spark plug 100 on the sheet will be referred to as the "forward end side," and the upper side of the spark plug 100 on the sheet will be referred to as the "rear end side."

The spark plug 100 includes a center electrode 10, an insulator 20, a metallic shell 30, and a ground electrode 40. A noble metal tip 50 is attached to the ground electrode 40 of the spark plug 100. In the present embodiment, the axis OL of the spark plug 100 also serves as respective center axes of the center electrode 10, the insulator 20, and the metallic shell 30.

The center electrode 10 of the spark plug 100 is a rod-like electrode member. In the present embodiment, the center electrode 10 is formed of a nickel alloy, such as Inconel (registered trademark), which contains nickel as a main component. The outer surface of the center electrode 10 is electrically insulated from the outside by the insulator 20. A forward end portion of the center electrode 10 projects from a forward end portion of the insulator 20. A rear end portion of the center electrode 10 is electrically connected to a metal terminal 19 at the rear end of the insulator 20. In the present embodiment, the rear end portion of the center electrode 10 is electrically connected to the metal terminal 19 at the rear end of the insulator 20 through a seal 16, a ceramic resistor 17, and a seal 18.

The insulator 20 of the spark plug 100 is a tubular insulator. In the present embodiment, the insulator 20 is formed by firing an insulating ceramic material such as alumina. The insulator 20 has an axial hole 28, which is a through-hole extending along the axis OL. The center electrode 10 is accommodated in the axial hole 28.

The metallic shell 30 of the spark plug 100 is a tubular metallic member. In the present embodiment, the metallic shell 30 is a nickel-plated metallic member formed of low-carbon steel. In other embodiments, the metallic shell 30 may be a zinc-plated metallic member formed of low-carbon steel, or an unplated (uncovered) metallic member formed of a nickel allow. The metallic shell 30 is crimped and fixed to the outer surface of the insulator 20 in a state in which the metallic shell 30 is electrically insulated from the center electrode 10.

The metallic shell 30 has an end surface 31 and a mount screw portion 32. The end surface 31 of the metallic shell 30 is an annular surface which constitutes a forward end portion of the metallic shell 30. The ground electrode 40 is joined to the end surface 31. The insulator 20 and the center electrode 10 project through the center space surrounded by the end surface 31. The mount screw portion 32 of the metallic shell 30 is a cylindrical tubular portion having a thread formed on the outer surface thereof. In the present embodiment, the spark plug 100 can be mounted to an internal combustion engine 200 by screwing the mount screw portion 32 of the metallic shell 30 into a screw hole 210 of the internal combustion engine 200.

Figure 2:
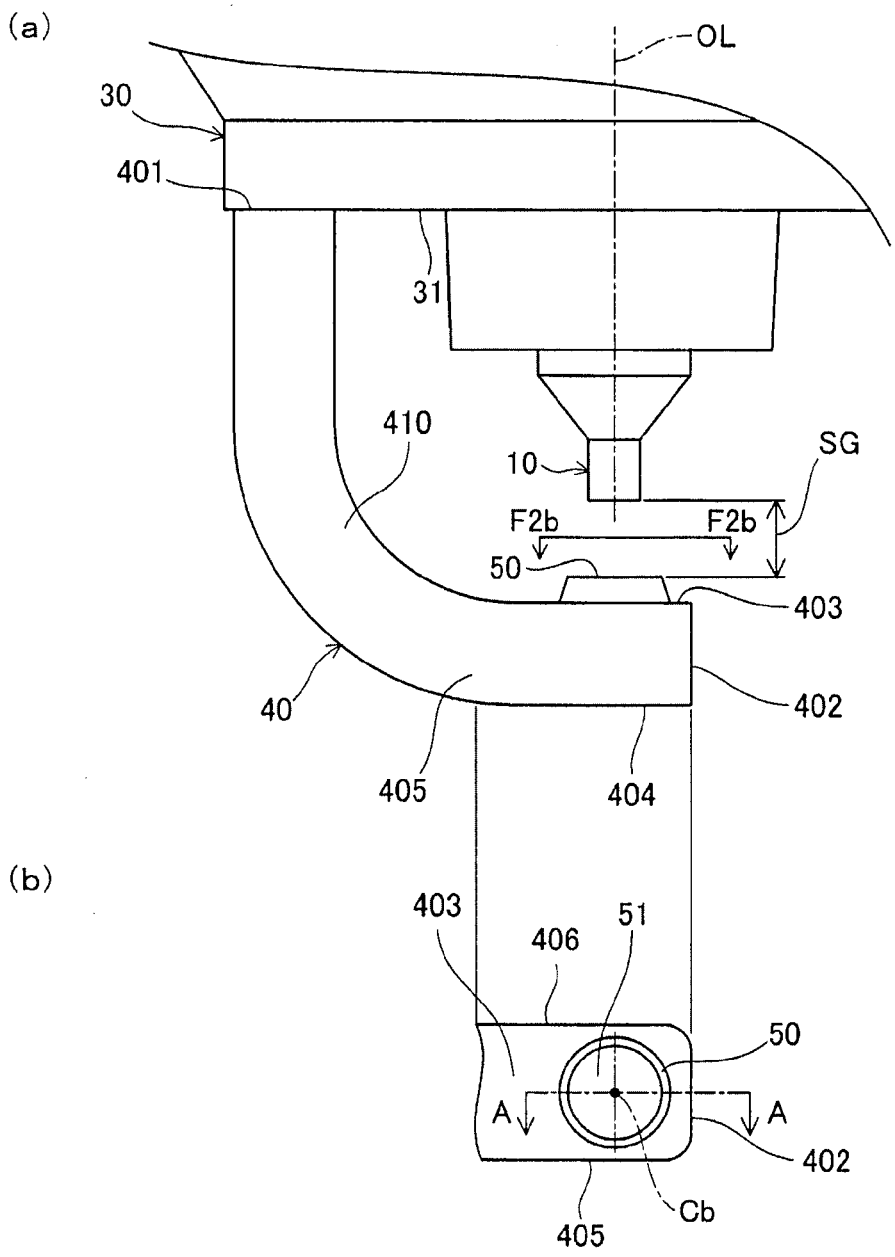
FIG. 2 is an explanatory view showing, on an enlarged scale, a ground electrode 40 of the spark plug 100 according to the first embodiment.

FIG. 2 is an explanatory view showing, on an enlarged scale, the ground electrode 40 of the spark plug 100. In section (a) of FIG. 2, the ground electrode 40, viewed from a direction orthogonal to the axis OL, is shown along with the forward end portion of the center electrode 10. Section (b) of FIG. 2 shows the ground electrode 40 viewed from a plane F2*b*-F2*b* in section (a) of FIG. 2. The ground electrode 40 of the spark plug 100 has an electrode base member 410 and a noble metal tip 50.

In the present embodiment, the electrode base member 410 has a rectangular cross section, and has four side surfaces adjacent to a proximal end portion 401 and a distal end portion 402; i.e., a side surface 403 and other three side surfaces 404, 405, and 406. The side surface 404 of the electrode base member 410 is a reverse surface located opposite the side surface 403. The side surfaces 405 and 406 are located adjacent to the side surfaces 403 and 404.

The electrode base member 410 of the ground electrode 40 is a bent rod-like electrode member. The electrode base member 410 extends from the end surface 31 of the metallic shell 30 along the axis OL, and then bends in a direction intersecting the axis OL. The proximal end portion 401 of the electrode base member 410 is joined to the end surface 31 of the metallic shell 30. The distal end portion 402 of the electrode base member 410 faces toward a direction intersecting the axis OL.

A portion of the side surface 403 of the electrode base member 410 located on the side toward the distal end portion 402 faces the end of the center electrode 10. The noble metal tip 50 is resistance-welded to a portion of the side surface 403 located on the side toward the distal end portion 402. In the present embodiment, the noble metal tip 50 is attached such that a portion of the noble metal tip 50 is embedded in the electrode base member 410. In the present embodiment, the melt welding used for attachment of the noble metal tip 50 is resistance welding.

A spark gap SG, which is a gap for generating a spark, is formed between the center electrode 10 and the noble metal tip 50. In a state in which the spark plug 100 is mounted to the internal combustion engine 200, a high voltage of 20,000 to 30,000 V is applied to the center electrode 10 through the metal terminal 19, whereby a spark can be generated at the spark gap SG.

The electrode base member 410 is formed of a heat-resisting nickel alloy, such as Inconel (registered trademark), which contains nickel, and also contains chromium (Cr) and/or iron (Fe).

The noble metal tip 50 of the ground electrode 40 is a metallic member which contains a noble metal which is more excellent than the electrode base member 410 in terms of durability against spark discharge and oxidation. In the present embodiment, the noble metal tip 50 is formed of a platinum-nickel alloy (e.g., Pt-10Ni, Pt-20Ni). The centroid Cb represents the centroid of a discharge surface 51 of the noble metal tip 50.

Since an iridium (Ir) alloy conventionally used for the noble metal tip is higher in melting point than the material of the electrode base member 410, at the time of welding, only the electrode base member 410 melts, and the noble metal tip hardly melts, which may lower weldability. Also, if a high Ni material (a material having a high nickel content) which is low in electrical resistance and is high in heat conductivity is used for the electrode base member, the electrode base member hardly melts, which may lower weldability. In the spark plug 100 of the first embodiment, the noble metal tip 50 is formed of a Pt—Ni alloy, and the electrode base member 410 is formed of a heat-resisting Ni alloy. Therefore, when the electrode base member 410 starts to melt, the noble metal tip 50 is embedded in the electrode base member 410, and the noble metal tip 50 then starts to melt, whereby the electrode base member 410 and the noble metal tip 50 are strongly joined together by diffusion bonding. Therefore, weldability is improved.

Figure 3:
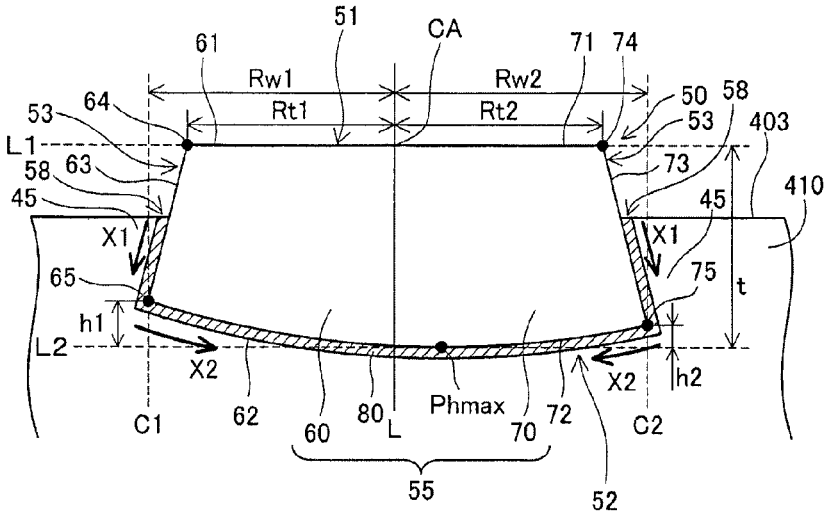
FIG. 3 is a cross-sectional view showing, in detail, the shape of a noble metal tip 50 according to the first embodiment.

FIG. 3 is a cross-sectional view showing, in detail, the shape of the noble metal tip 50. FIG. 3 shows a predetermined cross section 55 (a cross section taken along line A-A in section (b) of FIG. 2) of the noble metal tip 50 which contains a vertical line L passing through the centroid Cb of the discharge surface 51. The predetermined cross section 55 of the noble metal tip 50 has a flat discharge surface 51; a bottom surface 52 which is embedded in the ground electrode 40, to which the noble metal tip 50 is resistance-welded, and is convex toward a side opposite the discharge surface 51; and a side surface 53 whose width increases from the discharge surface 51 toward the bottom surface 52. A welding interface 80 (a diffusion layer formed as a result of diffusion bonding), in which the material of the noble metal tip 50 and the material of the ground electrode 40 are mixed together by the diffusion bonding, is formed between the noble metal tip 50 and the ground electrode 40. The predetermined cross section 55 is divided into two half cross sections (a first half cross section 60 and a second half cross section 70 different from the first half cross section 60) by the vertical line L. In FIG. 3, a straight line which is located on the discharge surface 51 is defined as a straight line L1, and a straight line which passes through a portion Phmax of the bottom surface 52 where the noble metal tip 50 has the maximum thickness and which is parallel to the discharge surface 51 is defined as a straight line L2. Also, on the predetermined cross section 55, the maximum thickness along a direction parallel to the vertical line L is defined as the maximum thickness t of the noble meal tip. Notably, the straight line L2 corresponds to the "first straight line" in claims.

The first half cross section 60 has a discharge surface 61, a bottom surface 62, and a side surface 63. In FIG. 3, an end point of the discharge surface 61 on the side toward the side surface 63 is referred to as an end point 64, and an end point of the bottom surface 62 on the side toward the side surface 63 is referred to as an end point 65. The second half cross section 70 has a discharge surface 71, a bottom surface 72, and a side surface 73. In FIG. 3, an end point of the discharge surface 71 on the side toward the side surface 73 is referred to as an end point 74, and an end point of the bottom surface 72 on the side toward the side surface 73 is referred to as an end point 75.

In the embodiment, the first half cross section 60 satisfies Expressions 1 and 2, and the second half cross section 70 satisfies Expressions 3 and 4.

$h1/t \leq 0.2$ (Expression 1)

$Rw1/Rt1 \geq 1.03$ (Expression 2)

$h2/t \leq 0.2$ (Expression 3)

$Rw2/Rt2 \geq 1.03$ (Expression 4)

Notably, on the first half cross section 60, the maximum width Rw1 of the noble metal tip is the maximum width along a direction orthogonal to the vertical line L;

the warpage height h1 of the noble metal tip is the distance, along a direction parallel to the vertical line L, between the straight line L2 and a position where the noble metal tip has the maximum width Rw1 (the end point 65 in the first embodiment); and the width Rt1 of the discharge surface is the distance between the intersection CA between the vertical line L and the discharge surface 61, and the end point 64 of the discharge surface 61.

Also, on the second half cross section 70, the maximum width Rw2 of the noble metal tip is the maximum width along the direction orthogonal to the vertical line L;

the warpage height h2 of the noble metal tip is the distance, along the direction parallel to the vertical line L, between the straight line L2 and a position where the noble metal tip has the maximum width Rw2 (the end point 75 in the first embodiment); and the width Rt2 of the discharge surface is the distance between the intersection CA between the vertical line L and the discharge surface 71, and the end point 74 of the discharge surface 71.

Notably, in the first embodiment, a straight line which passes through the first half cross section 60, which is parallel to the vertical line L, and which is the farthest from the vertical line L is defined as a straight line C1; and a straight line which passes through the second half cross section 70, which is parallel to the vertical line L, and which is the farthest from the vertical line L is defined as a straight line C2. The maximum width Rw1 is the distance between the vertical line L and the straight line C1 along a direction orthogonal to the vertical line L, and the maximum width Rw2 is the distance between the vertical line L and the straight line C2 along the direction orthogonal to the vertical line L.

After welding, the noble metal tip 50 has a shape such that, from the discharge surface 51 (61, 71) toward the bottom surface 52 (62, 72), the side surface 53 expands in the radial direction; in other words, the side surface 53 expands in a direction intersecting the axis OL such that the distance between the side surface 53 and the axis OL increases.

In general, the welding interface 80 is formed between the noble metal tip 50 and the ground electrode 40 by diffusion bonding performed through use of resistance welding. Oxidation of the welding interface 80 progresses due to various factors such as an environment of use and use over years. This oxidation of the welding interface 80 is also called "oxidation scale." Since oxidation scale lowers the joint strength between the noble metal tip 50 and the ground electrode 40, it has been desired to restrain the progress of oxidation scale, which is a cause of separation of the noble metal tip 50 from the ground electrode 40.

Oxidation scale starts from an end portion of the welding interface 80; i.e., from a boundary 58 between a region where the ground electrode 40 and the noble metal tip 50 are joined together and a region where the ground electrode 40 and the noble metal tip 50 are not joined together. The oxidation scale progresses along the side surfaces 63 and 73 as indicated by arrows X1, and then progresses toward the axis OL along the bottom surfaces 62 and 72 as indicated by arrows X2. In the spark plug 100 of the first embodiment, oxidation scale starts from the side surfaces 63, 73, and the progressing direction of the oxidation scale changes to the opposite direction when the oxidation scale progresses from the side surfaces 63 and 73 to the bottom surfaces 62 and 72. Specifically, after progressing in a "direction away from the axis OL" along the side surfaces 63 and 73, the progressing direction changes at the end points 65 and 75 such that the oxidation scale progress in a "direction toward the axis OL" along the bottom surfaces 62 and 72. When the progressing direction of oxidation scale changes to an approximately opposite direction as described above, the progress of oxidation scale is restrained.

The greater the angle by which the progressing direction of oxidation scale changes, the greater the degree to which the progress of oxidation scale is restrained. Therefore, it is preferred that the values of h1/t and h2/t be as small as possible.

Also, in the case where the noble metal tip 50 is formed such that the values of Rw1/Rt1 and Rw2/Rt2 become equal to or greater than a predetermined value, when the noble metal tip 50 is embedded in the ground electrode 40, the noble metal tip 50 has a shape (the shape of an inverted wedge) such that the noble metal tip 50 is held by an engagement portion 45 (formed by welding) of the ground electrode 40. As a result, even when the joint strength of the welding interface 80 decreases, it is possible to prevent separation of the noble metal tip 50 from the ground electrode 40 because the noble metal tip 50 is held by the engagement portion 45 of the ground electrode 40.

The area of the discharge surface 51 is not less than 0.79 $mm^2$, but not greater than 3.14 $mm^2$. Preferably, the discharge surface 51 has a diameter of 1.0 mm to 2.0 mm.

In the first embodiment, as a result of adjusting welding conditions or previously machining at least one of the ground electrode 40 and the noble metal tip 50 before performance of a welding process, the noble metal tip 50 resistance-welded to the ground electrode 40 has a shape which satisfies the above-mentioned conditional expressions (Expression 1) to (Expression 4), whereby the separation resistance of the noble metal tip 50 is improved. Next, a process of manufacturing the spark plug 100 will be described.

A2. Spark Plug Manufacturing Process

Figure 4:
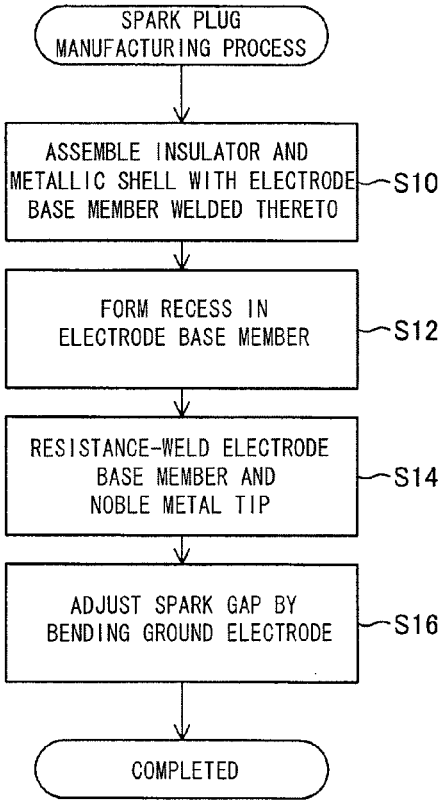
FIG. 4 is a flowchart showing a process of manufacturing the spark plug 100 according to the first embodiment.

FIG. 4 is a flowchart showing a process of manufacturing the spark plug 100 according to the first embodiment. In the process of manufacturing the spark plug 100, in order to manufacture the ground electrode 40, an electrode base member 410 and a noble metal tip 50*a* are prepared. The electrode base member 410 is welded to the metallic shell 30, and the insulator 20 and the metallic shell 30 having the electrode base member 410 welded thereto are assembled together (step S10). In the present embodiment, the electrode base member 410 prepared before attachment of the noble metal tip 50*a* thereto is a wire rod which extends straight, and is not bent, unlike the electrode base member 410 in the completed spark plug 100.

An annular recess is formed in a portion of the electrode base member 410 to which the noble metal tip 50 is to be attached (step S12).

Figure 5:
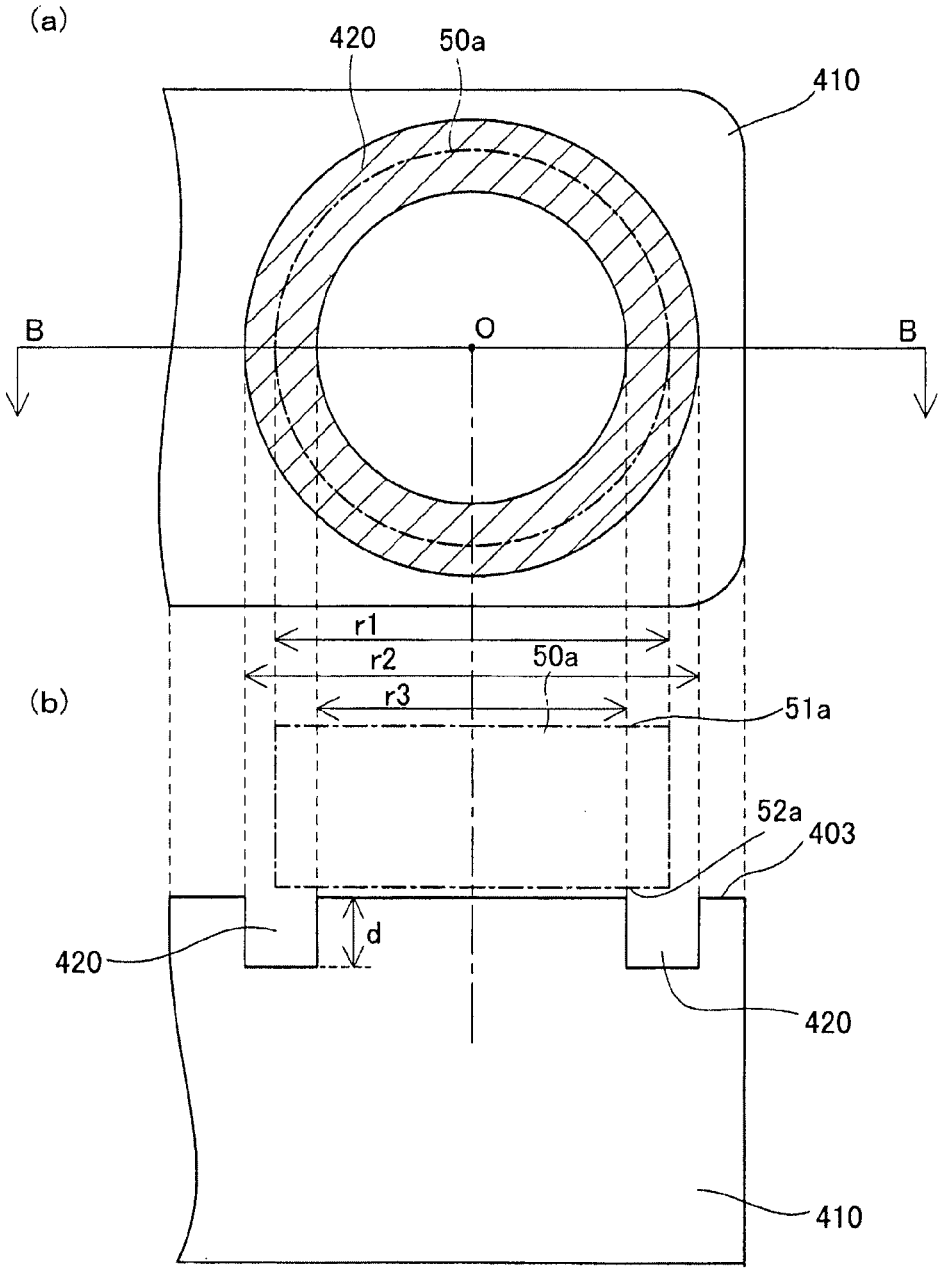
FIG. 5 is an explanatory view used for describing a recess of an electrode base member 410 according to the first embodiment.

FIG. 5 is an explanatory view used for describing the recess of the electrode base member 410 in the first embodiment. Section (a) of FIG. 5 is a plan view of the side surface 403 in a state before performance of welding, and section (b) of FIG. 5 is a cross-sectional view taken along line B-B in section (a)

of FIG. 5. FIG. 5 shows a state in which the noble metal tip 50*a* before being welded is disposed on the side surface 403. The noble metal tip 50*a* before being welded has a cylindrical shape such that the discharge surface 51*a* and the bottom surface 52*a* have substantially the same shape.

The electrode base member 410 is machined so as to form an annular recess 420 which extends along a peripheral portion of the bottom surface 52*a*. The recess 420 is an annular groove which is concentric with the generally circular bottom surface 52*a* of the noble metal tip 50*a*. The outer diameter r2 of the recess 420 is equal to or greater than the diameter r1 of the bottom surface 52*a*, and the inner diameter r3 of the recess 420 is 50% to 80% of the diameter r1 of the bottom surface 52*a*. The depth d of the recess 420 is equal to or less than 0.03 mm. Since the recess 420 is formed in this manner, the contact pressure which acts on the peripheral portion of the noble metal tip 50*a* during a pressing/heating process performed at the time of resistance welding decreases, and the difference in contact pressure between the center and peripheral portions of the noble metal tip 50*a* decreases. As a result, at the time of resistance welding, the current density of the peripheral portion of the noble metal tip 50*a* can be prevented from increasing, and generation of sputter can be restrained. The greater the diameter of the noble metal tip 50*a*, the greater the degree of restraint of local heating due to ununiformity of current density caused by the difference in contact pressure between the center and peripheral portions of the noble metal tip 50*a* and the greater the degree of restraint of generation of sputter caused by the local heating.

As shown in FIG. 3, the bottom surface 52 (62, 72) of the noble metal tip 50 welded to the ground electrode 40 is formed to be convex toward the side opposite to the discharge surface 51 (61, 71).

The electrode base member 410, on which the recess 420 has been formed, and the noble metal tip 50*a* are resistance-welded together (step S14). Specifically, after disposing the noble metal tip 50*a* on the recess 420 of the electrode base member 410, a current is caused to flow between the electrode base member 410 and the noble metal tip 50*a*, which are pressed against each other, whereby the noble metal tip 50*a* is resistance-welded to the electrode base member 410. For example, the resistance welding is performed by supplying a current of about 500 to 1000 A/mm$^2$ to the electrode base member 410 and the noble metal tip 50*a* for 0.1 sec to 0.5 sec while applying a pressure of 100 to 250 MPa to the electrode base member 410 and the noble metal tip 50*a*.

After completion of the resistance-welding of the electrode base member 410 and the noble metal tip 50*a*, various members which constitute the spark plug 100 are assembled, and the spark gap SG is adjusted by bending the distal end of the electrode base member 410, whereby the spark plug 100 is completed.

A3. Evaluation Results

There will be shown the results of four types of evaluation tests performed for the spark plug 100 manufactured in accordance with the above-described manufacturing method.

[Evaluation 1] Thermal Endurance Test 1:

Table 1 shows the results of a test performed for the spark plug 100 according to the first embodiment. Tables 2 and 3 show the results of tests performed for spark plugs (comparative examples) whose noble metal tips have a conventional shape. In Tables 1, 2, and 3, the item "discharge surface area" indicates the area of the noble metal tip; the item "cross section (suffix)" indicates the half cross section. The suffix "1" of the half cross section indicates the first half cross section 60, and the suffix "2" of the half cross section indicates the second half cross section 70. Symbols (t, h, etc.) indicated in other items correspond to the above-described symbols (the maximum thickness t, the warpage heights h1, h2). In these tables, h, Rt, Rw, h/t, and Rw/Rt in the row in which the suffix of the half cross section is "1" are h1, Rt1, Rw2, h1/t, and Rw1/Rt1 of the first half cross section 60, and h, Rt, Rw, h/t, and Rw/Rt in the row in which the suffix of the half cross section is "2" are h2, Rt2, Rw2, h2/t, and Rw2/Rt2 of the second half cross section 70. These also apply to the tables described below. In the thermal endurance test 1, the noble metal tip 50 of the spark plug 100 satisfies the following requirements.

(1) The first half cross section 60 satisfies (Expression 1) and (Expression 2).

(2) The second half cross section 70 satisfies (Expression 3) and (Expression 4).

The test was performed as follows. Each sample was mounted to an engine having six cylinders (displacement: 2000 cc), and the engine was operated by repeating an operation cycle of fully opening the throttle, maintaining the engine at a rotational speed of 5000 rpm for one minute, and maintaining the engine in an idling state for one minute. After the actual operation, the degree of progress of oxidation scale at the welding interface 80 between the ground electrode 40 and the noble metal tip 50 of each sample was visually checked. In the test, the following evaluation criteria were used:

Excellent "A": oxidation scale observed after engine operation over 150 hours is 25% or less Good "B": oxidation scale observed after engine operation over 125 hours is 25% or less, and oxidation scale observed after engine operation over 150 hours is greater than 25%

Poor "C": oxidation scale observed after engine operation over 100 hours is 25% or less, and oxidation scale observed after engine operation over 125 hours is greater than 25%

TABLE 1

| Sample | Discharge surface area [mm$^2$] | Cross section (suffix) | t | h | Rt | Rw | h/t | Rw/Rt | Test result |
|---|---|---|---|---|---|---|---|---|---|
| Embodiment | 2.011 | 1 | 0.391 | 0.007 | 0.784 | 0.824 | 0.20 | 1.05 | A |
| | | 2 | 0.391 | 0.077 | 0.784 | 0.817 | 0.20 | 1.04 | |
| Embodiment | 2.011 | 1 | 0.399 | 0.062 | 0.766 | 0.820 | 0.16 | 1.07 | A |
| | | 2 | 0.399 | 0.031 | 0.766 | 0.801 | 0.08 | 1.05 | |
| Embodiment | 2.011 | 1 | 0.399 | 0.035 | 0.753 | 0.797 | 0.09 | 1.06 | A |
| | | 2 | 0.399 | 0.031 | 0.753 | 0.789 | 0.08 | 1.05 | |
| Embodiment | 2.011 | 1 | 0.383 | 0.062 | 0.768 | 0.844 | 0.16 | 1.10 | A |
| | | 2 | 0.383 | 0.015 | 0.768 | 0.805 | 0.04 | 1.05 | |
| Embodiment | 2.011 | 1 | 0.380 | 0.020 | 0.784 | 0.835 | 0.05 | 1.07 | A |
| | | 2 | 0.380 | 0.012 | 0.784 | 0.808 | 0.03 | 1.03 | |

TABLE 1-continued

| Sample | Discharge surface area [mm$^2$] | Cross section (suffix) | t | h | Rt | Rw | h/t | Rw/Rt | Test result |
|---|---|---|---|---|---|---|---|---|---|
| Embodiment | 2.011 | 1 | 0.388 | 0.020 | 0.796 | 0.831 | 0.05 | 1.04 | A |
| | | 2 | 0.388 | 0.024 | 0.796 | 0.835 | 0.06 | 1.05 | |
| Embodiment | 2.011 | 1 | 0.372 | 0.035 | 0.784 | 0.815 | 0.09 | 1.04 | A |
| | | 2 | 0.372 | 0.031 | 0.784 | 0.827 | 0.08 | 1.06 | |
| Embodiment | 2.011 | 1 | 0.393 | 0.035 | 0.799 | 0.858 | 0.09 | 1.07 | A |
| | | 2 | 0.393 | 0.028 | 0.799 | 0.825 | 0.07 | 1.03 | |
| Embodiment | 2.011 | 1 | 0.393 | 0.043 | 0.785 | 0.843 | 0.11 | 1.07 | A |
| | | 2 | 0.393 | 0.013 | 0.785 | 0.815 | 0.03 | 1.04 | |
| Embodiment | 2.011 | 1 | 0.378 | 0.018 | 0.791 | 0.860 | 0.05 | 1.09 | A |
| | | 2 | 0.378 | 0.025 | 0.791 | 0.818 | 0.07 | 1.03 | |
| Embodiment | 0.785 | 1 | 0.296 | 0.015 | 0.500 | 0.518 | 0.05 | 1.04 | A |
| | | 2 | 0.296 | 0.037 | 0.500 | 0.533 | 0.13 | 1.07 | |
| Embodiment | 0.785 | 1 | 0.289 | 0.030 | 0.488 | 0.548 | 0.10 | 1.12 | A |
| | | 2 | 0.289 | 0.015 | 0.488 | 0.540 | 0.05 | 1.11 | |
| Embodiment | 0.785 | 1 | 0.281 | 0.052 | 0.481 | 0.525 | 0.18 | 1.09 | A |
| | | 2 | 0.281 | 0.037 | 0.481 | 0.540 | 0.13 | 1.12 | |
| Embodiment | 0.636 | 1 | 0.382 | 0.059 | 0.441 | 0.490 | 0.15 | 1.11 | A |
| | | 2 | 0.382 | 0.049 | 0.441 | 0.470 | 0.13 | 1.07 | |
| Embodiment | 0.636 | 1 | 0.392 | 0.049 | 0.436 | 0.461 | 0.13 | 1.06 | A |
| | | 2 | 0.392 | 0.039 | 0.436 | 0.480 | 0.10 | 1.10 | |
| Embodiment | 0.636 | 1 | 0.382 | 0.069 | 0.441 | 0.500 | 0.18 | 1.13 | A |
| | | 2 | 0.382 | 0.059 | 0.441 | 0.480 | 0.15 | 0.09 | |

TABLE 2

| Sample | Discharge surface area [mm$^2$] | Cross section (suffix) | t | h | Rt | Rw | h/t | Rw/Rt | Test result |
|---|---|---|---|---|---|---|---|---|---|
| Comparative | 0.636 | 1 | 0.222 | 0.105 | 0.495 | 0.571 | 0.47 | 1.15 | B |
| Example | | 2 | 0.222 | 0.096 | 0.495 | 0.558 | 0.43 | 1.13 | |
| Comparative | 0.636 | 1 | 0.236 | 0.112 | 0.483 | 0.555 | 0.47 | 1.15 | B |
| Example | | 2 | 0.236 | 0.100 | 0.483 | 0.530 | 0.42 | 1.10 | |
| Comparative | 0.636 | 1 | 0.254 | 0.098 | 0.465 | 0.530 | 0.39 | 1.14 | B |
| Example | | 2 | 0.254 | 0.107 | 0.465 | 0.530 | 0.42 | 1.14 | |
| Comparative | 0.636 | 1 | 0.256 | 0.126 | 0.452 | 0.504 | 0.49 | 1.11 | B |
| Example | | 2 | 0.256 | 0.137 | 0.452 | 0.490 | 0.53 | 1.08 | |
| Comparative | 0.636 | 1 | 0.294 | 0.114 | 0.413 | 0.481 | 0.39 | 1.17 | B |
| Example | | 2 | 0.294 | 0.114 | 0.413 | 0.459 | 0.39 | 1.11 | |
| Comparative | 0.636 | 1 | 0.233 | 0.121 | 0.463 | 0.530 | 0.52 | 1.15 | B |
| Example | | 2 | 0.233 | 0.105 | 0.463 | 0.537 | 0.45 | 1.16 | |
| Comparative | 0.636 | 1 | 0.250 | 0.116 | 0.431 | 0.525 | 0.46 | 1.22 | B |
| Example | | 2 | 0.250 | 0.128 | 0.431 | 0.536 | 0.51 | 1.24 | |
| Comparative | 0.636 | 1 | 0.235 | 0.102 | 0.456 | 0.537 | 0.43 | 1.18 | B |
| Example | | 2 | 0.235 | 0.142 | 0.456 | 0.532 | 0.60 | 1.17 | |
| Comparative | 2.011 | 1 | 0.392 | 0.010 | 0.794 | 0.811 | 0.03 | 1.02 | C |
| Example | | 2 | 0.392 | 0.025 | 0.794 | 0.818 | 0.06 | 1.03 | |
| Comparative | 2.011 | 1 | 0.375 | 0.027 | 0.783 | 0.831 | 0.07 | 1.06 | C |
| Example | | 2 | 0.375 | 0.025 | 0.783 | 0.799 | 0.07 | 1.02 | |
| Comparative | 0.636 | 1 | 0.252 | 0.131 | 0.453 | 0.558 | 0.52 | 1.23 | B |
| Example | | 2 | 0.252 | 0.127 | 0.453 | 0.547 | 0.50 | 1.21 | |
| Comparative | 0.636 | 1 | 0.237 | 0.155 | 0.476 | 0.543 | 0.65 | 1.14 | B |
| Example | | 2 | 0.237 | 0.127 | 0.476 | 0.581 | 0.54 | 1.22 | |
| Comparative | 0.636 | 1 | 0.231 | 0.119 | 0.478 | 0.583 | 0.51 | 1.22 | B |
| Example | | 2 | 0.231 | 0.112 | 0.478 | 0.555 | 0.49 | 1.16 | |
| Comparative | 0.636 | 1 | 0.257 | 0.146 | 0.449 | 0.551 | 0.57 | 1.23 | B |
| Example | | 2 | 0.257 | 0.055 | 0.449 | 0.547 | 0.21 | 1.22 | |
| Comparative | 0.636 | 1 | 0.271 | 0.163 | 0.452 | 0.536 | 0.60 | 1.19 | B |
| Example | | 2 | 0.271 | 0.072 | 0.452 | 0.553 | 0.27 | 1.23 | |
| Comparative | 0.636 | 1 | 0.263 | 0.117 | 0.456 | 0.549 | 0.44 | 1.20 | B |
| Example | | 2 | 0.263 | 0.051 | 0.456 | 0.515 | 0.19 | 1.13 | |
| Comparative | 0.636 | 1 | 0.267 | 0.155 | 0.454 | 0.568 | 0.58 | 1.25 | B |
| Example | | 2 | 0.267 | 0.057 | 0.454 | 0.530 | 0.21 | 1.17 | |
| Comparative | 0.636 | 1 | 0.261 | 0.112 | 0.419 | 0.577 | 0.43 | 1.38 | B |
| Example | | 2 | 0.261 | 0.081 | 0.419 | 0.500 | 0.31 | 1.19 | |
| Comparative | 0.636 | 1 | 0.261 | 0.110 | 0.443 | 0.549 | 0.42 | 1.24 | B |
| Example | | 2 | 0.261 | 0.053 | 0.443 | 0.524 | 0.20 | 1.18 | |
| Comparative | 2.011 | 1 | 0.395 | 0.018 | 0.784 | 0.801 | 0.05 | 1.02 | C |
| Example | | 2 | 0.395 | 0.097 | 0.784 | 0.847 | 0.25 | 1.08 | |
| Comparative | 0.636 | 1 | 0.201 | 0.068 | 0.462 | 0.524 | 0.34 | 1.13 | B |
| Example | | 2 | 0.201 | 0.083 | 0.462 | 0.522 | 0.41 | 1.13 | |

TABLE 3

| Sample | Discharge surface area [mm$^2$] | Cross section (suffix) | t | h | Rt | Rw | h/t | Rw/Rt | Test result |
|---|---|---|---|---|---|---|---|---|---|
| Comparative | 2.011 | 1 | 0.310 | 0.028 | 0.544 | 0.583 | 0.09 | 1.07 | C |
| Example | | 2 | 0.310 | 0.127 | 0.544 | 0.645 | 0.41 | 1.19 | |
| Comparative | 2.011 | 1 | 0.331 | 0.052 | 0.500 | 0.555 | 0.16 | 1.11 | C |
| Example | | 2 | 0.331 | 0.170 | 0.500 | 0.636 | 0.51 | 1.27 | |
| Comparative | 2.011 | 1 | 0.346 | 0.084 | 0.608 | 0.662 | 0.24 | 1.09 | C |
| Example | | 2 | 0.346 | 0.123 | 0.608 | 0.692 | 0.35 | 1.14 | |
| Comparative | 2.011 | 1 | 0.346 | 0.073 | 0.563 | 0.662 | 0.21 | 1.18 | C |
| Example | | 2 | 0.346 | 0.153 | 0.563 | 0.660 | 0.44 | 1.17 | |
| Comparative | 2.011 | 1 | 0.329 | 0.074 | 0.799 | 0.877 | 0.22 | 1.10 | C |
| Example | | 2 | 0.329 | 0.044 | 0.799 | 0.818 | 0.13 | 1.02 | |
| Comparative | 2.011 | 1 | 0.333 | 0.078 | 0.797 | 0.881 | 0.23 | 1.10 | C |
| Example | | 2 | 0.333 | 0.037 | 0.797 | 0.836 | 0.11 | 1.05 | |
| Comparative | 2.011 | 1 | 0.333 | 0.104 | 0.801 | 0.899 | 0.31 | 1.12 | C |
| Example | | 2 | 0.333 | 0.048 | 0.801 | 0.836 | 0.14 | 1.04 | |
| Comparative | 2.011 | 1 | 0.333 | 0.067 | 0.803 | 0.888 | 0.20 | 1.11 | C |
| Example | | 2 | 0.333 | 0.141 | 0.803 | 0.884 | 0.42 | 1.10 | |
| Comparative | 2.011 | 1 | 0.329 | 0.063 | 0.786 | 0.858 | 0.19 | 1.09 | C |
| Example | | 2 | 0.329 | 0.022 | 0.786 | 0.792 | 0.07 | 1.01 | |
| Comparative | 2.011 | 1 | 0.337 | 0.130 | 0.808 | 0.918 | 0.38 | 1.14 | C |
| Example | | 2 | 0.337 | 0.048 | 0.808 | 0.836 | 0.14 | 1.03 | |
| Comparative | 2.011 | 1 | 0.337 | 0.118 | 0.805 | 0.910 | 0.35 | 1.13 | C |
| Example | | 2 | 0.337 | 0.067 | 0.805 | 0.847 | 0.20 | 1.05 | |
| Comparative | 2.011 | 1 | 0.329 | 0.093 | 0.807 | 0.899 | 0.28 | 1.11 | C |
| Example | | 2 | 0.329 | 0.070 | 0.807 | 0.862 | 0.21 | 1.07 | |
| Comparative | 2.011 | 1 | 0.397 | 0.021 | 0.788 | 0.802 | 0.05 | 1.02 | C |
| Example | | 2 | 0.397 | 0.036 | 0.788 | 0.809 | 0.09 | 1.03 | |

As is clear from the test results shown in Tables 1, 2, and 3, in the case of the spark plug 100 of the first embodiment in which the welding shape of the noble metal tip 50 satisfies the requirements; i.e., the first half cross section 60 satisfies (Expression 1) and (Expression 2) and the second half cross section 70 satisfies (Expression 3) and (Expression 4), the progress of oxidation scale at the welding interface 80 between the noble metal tip 50 and the electrode base member 410 can be restrained.

[Evaluation 2] Thermal Endurance Test 2:

[Evaluation 3] Full-Throttle Endurance Test

In the thermal endurance test 2, the noble metal tip 50 of the spark plug 100 satisfies the following requirements.

(1) The first half cross section 60 satisfies (Expression 1) and (Expression 2).

(2) The second half cross section 70 satisfies (Expression 3) and (Expression 4).

(3) The area of the discharge surface 51 of the noble metal tip 50 is not less than 0.79 mm$^2$ but not greater than 3.14 mm$^2$.

(4) The diameter of the discharge surface 51 of the noble metal tip 50 is not less than 1.0 mm but not greater than 2.0 mm.

The thermal endurance test 2 and the full-throttle endurance test were performed in the same manner as the thermal endurance test 1. Table 4 shows the results of these tests.

In the thermal endurance test 2, after the actual operation, the degree of progress of oxidation scale at the welding interface 80 between the ground electrode 40 and the noble metal tip 50 of each sample was visually checked. In the thermal endurance test 2, the following evaluation criteria were employed:

Excellent "A": oxidation scale observed after engine operation over 175 hours is 25% or less Good "B": oxidation scale observed after engine operation over 150 hours is 25% or less, and oxidation scale observed after engine operation over 175 hours is greater than 25%

In the full throttle endurance test, an increase in the park gap SG between the noble metal tip 50 of the ground electrode 40 and the center electrode 10 of each sample after engine operation over 100 hours was measured. In the full throttle endurance test, the samples were evaluated as follows.

Excellent "A": an increase in the spark gap SG is equal to or less than 0.05 mm

Good "B": an increase in the spark gap SG is greater than 0.05 mm but not greater than 0.1 mm

TABLE 4

| Discharge surface area [mm$^2$] | Cross section (suffix) | t | h | Rt | Rw | h/t | Rw/Rt | Result of thermal endurance test | Result of full throttle endurance test |
|---|---|---|---|---|---|---|---|---|---|
| 0.64 | 1 | 0.392 | 0.076 | 0.454 | 0.498 | 0.19 | 1.10 | A | B |
| | 2 | 0.392 | 0.047 | 0.454 | 0.503 | 0.12 | 1.11 | | |
| 0.79 | 1 | 0.282 | 0.031 | 0.501 | 0.584 | 0.11 | 1.17 | A | A |
| | 2 | 0.282 | 0.028 | 0.501 | 0.567 | 0.10 | 1.13 | | |
| 1.13 | 1 | 0.294 | 0.028 | 0.603 | 0.625 | 0.10 | 1.04 | A | A |
| | 2 | 0.294 | 0.035 | 0.603 | 0.699 | 0.12 | 1.16 | | |
| 2.01 | 1 | 0.391 | 0.063 | 0.813 | 0.860 | 0.16 | 1.06 | A | A |
| | 2 | 0.391 | 0.070 | 0.813 | 0.855 | 0.18 | 1.05 | | |
| 3.14 | 1 | 0.372 | 0.042 | 0.999 | 1.060 | 0.11 | 1.06 | A | A |
| | 2 | 0.372 | 0.045 | 0.999 | 1.040 | 0.12 | 1.04 | | |

TABLE 4-continued

| Discharge surface area [mm$^2$] | Cross section (suffix) | t | h | Rt | Rw | h/t | Rw/Rt | Result of thermal endurance test | Result of full throttle endurance test |
|---|---|---|---|---|---|---|---|---|---|
| 3.80 | 1 | 0.389 | 0.035 | 1.100 | 1.135 | 0.09 | 1.03 | B | A |
| | 2 | 0.389 | 0.049 | 1.100 | 1.150 | 0.13 | 1.05 | | |

As is apparent from the test results shown in Table 4, in the case where the noble metal tip 50 is welded to the electrode base member 410 such that the welding shape of the noble metal tip 50 satisfies the requirements; that is, the first half cross section 60 satisfies (Expression 1) and (Expression 2), and the second half cross section 70 satisfies (Expression 3) and (Expression 4), and the area of the discharge surface 51 is not less than 0.79 mm$^2$ but not greater than 3.14 mm$^2$, the progress of oxidation scale can be restrained further, and an increase in the spark gap SG can be reduced.

[Evaluation 4] Thermal Endurance Test 3

In the thermal endurance test 3, the noble metal tip 50 of the spark plug 100 satisfies the following requirements.

(1) The first half cross section 60 satisfies (Expression 1) and (Expression 2).

(2) The second half cross section 70 satisfies (Expression 3) and (Expression 4).

(3) The noble metal tip 50 and the electrode base member 410 are formed of materials shown in Table 5

The thermal endurance test 3 was performed in the same manner as the thermal endurance test 1. In the thermal endurance test 3, the following evaluation criteria were employed:

Excellent "A": oxidation scale observed after engine operation over 150 hours is 250 or less Good "B": oxidation scale observed after engine operation over 100 hours is 25% or less, and oxidation scale observed after engine operation over 150 hours is greater than 25%

TABLE 5

| | Tip | |
|---|---|---|
| Base member | Pt—10Ni<br>1,550 (° C.)<br>31 (μΩ · cm) | Ir—10Rh<br>2,360 (° C.)<br>11 (μΩ · cm) |
| INC601<br>1,360 (° C.)<br>119 (μΩ · cm) | A | B |
| Pure Ni for industrial use<br>1,455 (° C.)<br>7.2 (μΩ · cm) | B | B |

melting point (° C.)
resistivity (μΩ · cm)

In the spark plug 100 of the first embodiment, the electrode base member 410 is formed of Inconel (INC601) and the noble metal tip 50 is formed of a platinum-nickel alloy (Pt-10Ni), which is one of combinations of the materials of the electrode base member 410 and the materials of the noble metal tip 50 shown in Table 5. In Table 5, in addition to the name of each material, its melting point (unit: ° C.) and resistivity (μΩ·cm) are shown.

As is clear from the test results shown in Table 5, in the case where the electrode base member 410 is formed of Inconel (INC601) and the noble metal tip 50 is formed of a platinum-nickel alloy (Pt-10Ni), the progress of oxidation scale at the welding interface 80 can be restrained.

According to the above-described spark plug 100 of the first embodiment, the noble metal tip 50 is formed such that first and second half cross sections 60 and 70, which are formed by dividing the cross section of the noble metal tip 50 which passes through CA of the discharge surface 51 by the vertical line L passing through the centroid Cb, satisfy the following expressions:

$$h1/t \leq 0.2 \text{ and } Rw1/Rt1 \geq 1.03, \text{ and}$$

$$h2/t \leq 0.2 \text{ and } Rw2/Rt2 \geq 1.03.$$

Accordingly, the side surface of the noble metal tip 50 is formed to expand away from the axis OL, and the bottom surface 52 extends from the side surface 53 toward the axis OL. Thus, oxidation scale progresses in a direction away from the axis OL along the side surface 53, and then progresses from the side surface 53 in a direction toward the axis OL along the bottom surface 52. When oxidation scale progresses from the side surface 53 to the bottom surface 52, the progressing direction of oxidation scale changes to an approximately opposite direction, whereby progress of oxidation scale can be restrained, and the separation resistance of the noble metal tip 50 can be improved.

According to the spark plug 100 of the first embodiment, the noble metal tip 50 is embedded in the electrode base member 410 such that the cross section 55 has the shape of an inverted wedge. Therefore, the separation resistance of the noble metal tip 50 can be improved.

According to the spark plug 100 of the first embodiment, the bottom surface 52 of the noble metal tip 50 is convex toward the side opposite the discharge surface 51. Accordingly, when oxidation scale progresses from the side surface 53 to the bottom surface 52, the progressing direction of oxidation scale changes to an approximately opposite direction, whereby progress of oxidation scale can be restrained.

According to the spark plug 100 of the first embodiment, the area of the discharge surface 51 is equal to or greater than 0.79 mm$^2$. Therefore, an increase in the spark gap between the ground electrode 40 and the center electrode 10 can be restrained. Also, since the area of the discharge surface 51 is equal to or less than 3.14 mm$^2$, the separation resistance can be improved.

According to the spark plug 100 of the first embodiment, the noble metal tip 50 is formed of a Pt—Ni alloy, and the electrode base member 410 to which the noble metal tip 50 is welded is formed of an Ni alloy containing Cr and Fe. Accordingly, the noble metal tip 50 and the electrode base member 410 can be welded more easily by resistance welding.

B. Second Embodiment

In the first embodiment, the bottom surface 352 of the noble metal tip 50 is formed to be convex toward the side opposite the discharge surface 351. In the second embodiment, a noble metal tip 350 has a bottom surface 352 which is concave toward the discharge surface 351.

B1. Cross-Sectional Shape of the Noble Metal Tip 350

Figure 6:
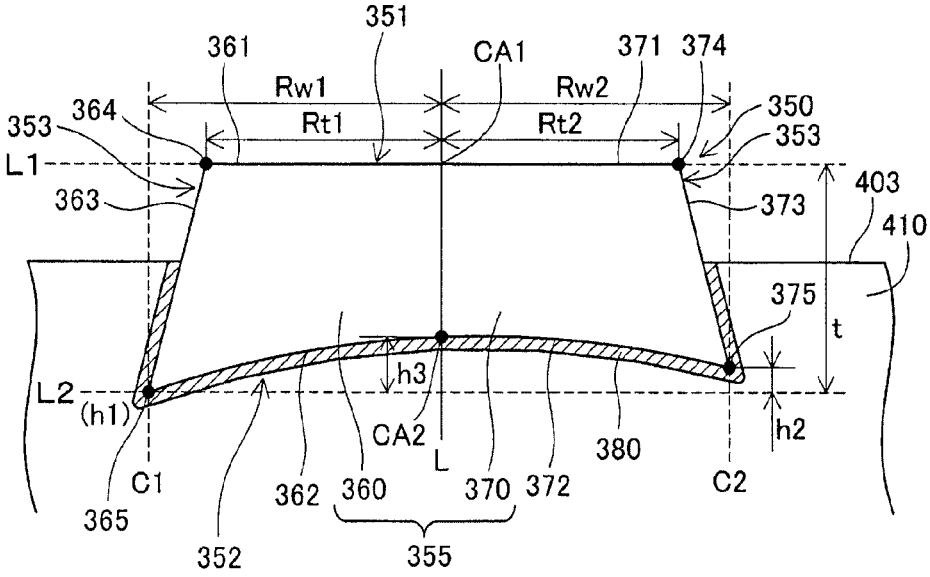
FIG. 6 is a cross-sectional view showing, in detail, the shape of a noble metal tip 350 according to a second embodiment.

FIG. 6 is a cross-sectional view showing, in detail, the shape of the noble metal tip 350 according to the second embodiment. FIG. 6 shows a predetermined cross section 355 of the noble metal tip 350 which contains the vertical line L passing through the centroid of the discharge surface 351. The predetermined cross section 355 of the noble metal tip 350 has a flat discharge surface 351; a bottom surface 352 which is embedded in the ground electrode 40, to which the noble metal tip 350 is resistance-welded, and is concave toward the discharge surface 351; and a side surface 353 whose width increases from the discharge surface 351 toward the bottom surface 352. A welding interface 380 (a diffusion layer formed as a result of diffusion bonding), in which the material of the noble metal tip 350 and the material of the ground electrode 40 are mixed together by the diffusion bonding, is formed between the noble metal tip 350 and the ground electrode 40. The predetermined cross section 355 is divided into two half cross sections (a first half cross section 360 and a second half cross section 370 different from the first half cross section 360) by the vertical line L. In FIG. 6, a straight line which is located on the discharge surface 351 is defined as a straight line L1, and a straight line which passes through a portion (an end point 365 in the second embodiment) of the bottom surface 352 where the noble metal tip 350 has the maximum thickness and which is parallel to the discharge surface 351 is defined as a straight line L2. On the predetermined cross section 355, the maximum thickness along a direction parallel to the vertical line L is defined as the maximum thickness t of the noble metal tip. Also, as in the case of the first embodiment, the electrode base member 410 is formed of Inconel (INC601) and the noble metal tip 350 is formed of a platinum-nickel alloy (Pt-10Ni).

The first half cross section 360 has a discharge surface 361, a bottom surface 362, and a side surface 363. In FIG. 6, an end point of the discharge surface 361 on the side toward the side surface 363 is referred to as an end point 364, and an end point of the bottom surface 362 on the side toward the side surface 363 is referred to as an end point 365. The second half cross section 370 has a discharge surface 371, a bottom surface 372, and a side surface 373. In FIG. 6, an end point of the discharge surface 371 on the side toward the side surface 373 is referred to as an end point 374, and an end point of the bottom surface 372 on the side toward the side surface 373 is referred to as an end point 375.

In the second embodiment, the first half cross section 360 satisfies Expressions 1 and 2, and the second half cross section 370 satisfies Expressions 3 and 4.

$$h1/t \leq 0.2 \quad \text{(Expression 1)}$$

$$Rw1/Rt1 \geq 1.03 \quad \text{(Expression 2)}$$

$$h2/t \leq 0.2 \quad \text{(Expression 3)}$$

$$Rw2/Rt2 \geq 1.03 \quad \text{(Expression 4)}$$

Notably, on the first half cross section 360, the maximum width Rw1 of the noble metal tip is the maximum width along a direction orthogonal to the vertical line L;

the warpage height h1 of the noble metal tip is the distance, along a direction parallel to the vertical line L, between the straight line L2 and a position where the noble metal tip has the maximum width Rw1 (the end point 365 in the second embodiment); and the width Rt1 of the discharge surface is the distance between the intersection CA1 between the vertical line L and the discharge surface 361, and the end point 364 of the discharge surface 361.

Also, on the second half cross section 370, the maximum width Rw2 of the noble metal tip is the maximum width along the direction orthogonal to the vertical line L;

the warpage height h2 of the noble metal tip is the distance, along the direction parallel to the vertical line L, between the straight line L2 and a position where the noble metal tip has the maximum width Rw2 (the end point 375 in the second embodiment); and the width Rt2 of the discharge surface is the distance between the intersection CA1 between the vertical line L and the discharge surface 371, and the end point 374 of the discharge surface 371.

Notably, in the second embodiment, a straight line which passes through the first half cross section 360, which is parallel to the vertical line L, and which is the farthest from the vertical line L is defined as a straight line C1; and a straight line which passes through the second half cross section 370, which is parallel to the vertical line L, and which is the farthest from the vertical line L is defined as a straight line C2. The maximum width Rw1 is the distance between the vertical line L and the straight line C1 along the direction orthogonal to the vertical line L, and the maximum width Rw2 is the distance between the vertical line L and the straight line C2 along the direction orthogonal to the vertical line L.

After welding, the noble metal tip 350 has a shape such that, from the discharge surface 351 (361, 371) toward the bottom surface 352 (362, 372), the side surface 353 expands in the radial direction; in other words, the side surface 353 expands in a direction intersecting the axis OL such that the distance between the side surface 353 and the axis OL increases.

Also, the distance h3 between the straight line L2 and the intersection CA2 between the vertical line L and the bottom surface 352 measured along a direction parallel to the vertical line L satisfies the following Expressions 5 and 6.

$$h3 > h1 \quad \text{(Expression 5)}$$

$$h3 > h2 \quad \text{(Expression 6)}$$

Notably, in the second embodiment, since the point where the noble metal tip 350 has the maximum width Rwt is the end point 365, h1=0.

As in the case of the first embodiment, the noble metal tip 350 and the electrode base member 410 are formed of different materials and therefore differ in coefficient of thermal expansion. In the second embodiment, since the electrode base member 410 is formed of Inconel (INC601) and the noble metal tip 350 is formed of a platinum-nickel alloy (Pt-10Ni), the noble metal tip 350 is smaller in coefficient of thermal expansion than the electrode base member 410. Therefore, when the ground electrode 40 is heated, a thermal stress acts on the joint portion between the noble metal tip 350 and the electrode base member 410, whereby the joint strength between the noble metal tip 350 and the electrode base member 410 decreases. In particular, in the case where the bottom surface of the noble metal tip is formed to be convex toward the side opposite the discharge surface, since a force which separates the noble metal tip from the electrode base member 410 is produced, the possibility of separation of the noble metal tip from the electrode base member 410 increases. In the case where the noble metal tip 350 and the electrode base member 410 are welded together such that the noble metal tip 350 satisfies not only Expressions 1 to 4 but also Expressions 5 and 6 as in the second embodiment, the thermal stress acting on the noble metal tip 350 can be restrained, and the separation resistance of the noble metal tip 350 can be improved.

B2. Stress Numerical Simulation

Figure 7:
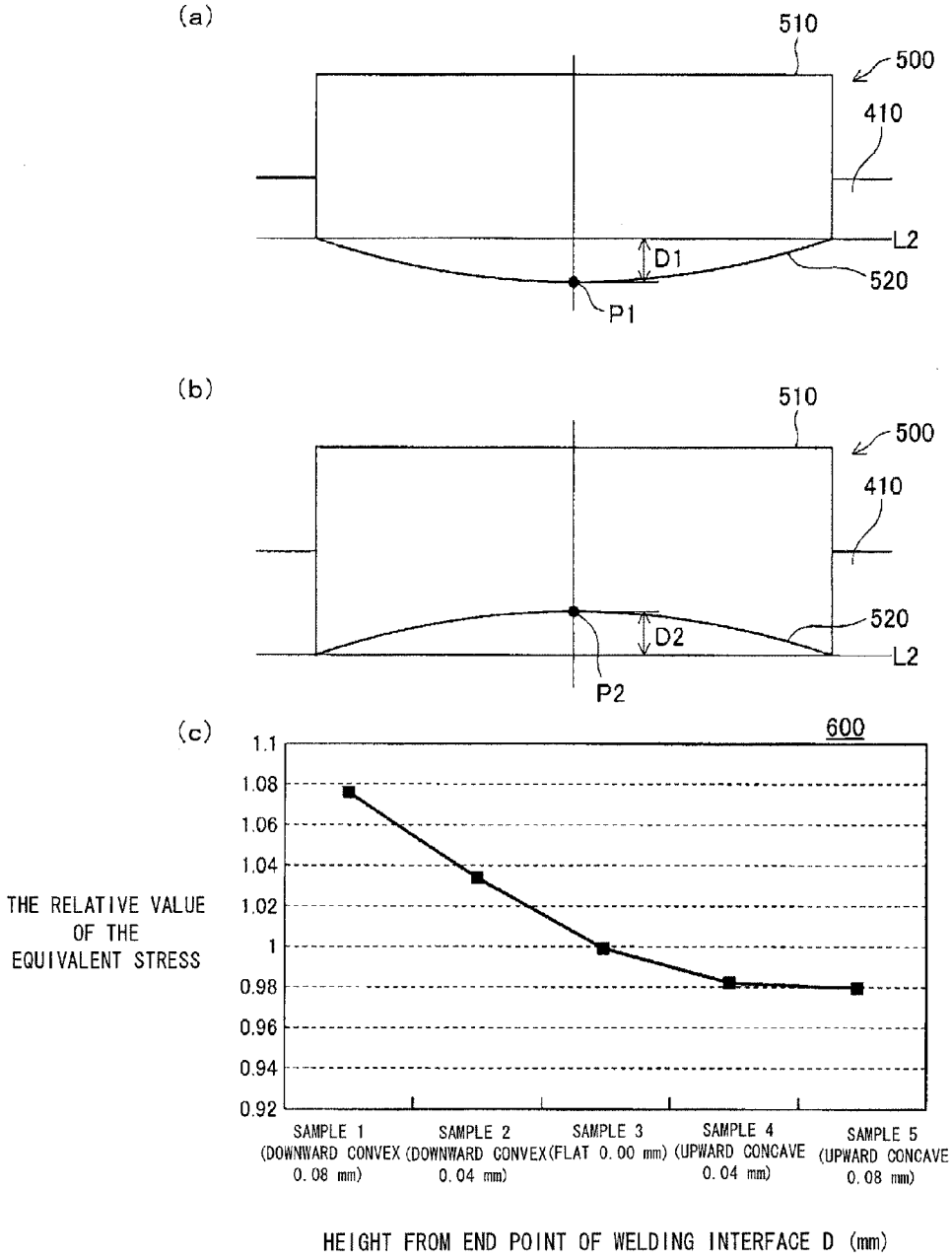
FIG. 7 is an explanatory view used for describing thermal stress acting on the noble metal tip.

FIG. 7 is an explanatory view used for describing thermal stress acting on the noble metal tip. Section (a) of FIG. 7 shows an evaluation point for thermal stress simulation in the case where the noble metal tip has a bottom surface which is convex toward the side opposite the discharge surface. Section (b) of FIG. 7 shows an evaluation point for the thermal stress simulation in the case where the noble metal tip has a bottom surface which is concave toward the discharge surface. Section (c) of FIG. 7 shows the results of the simulation for determining an equivalent stress (Mises stress) at the evaluation point for different samples which differ in the shape of the bottom surface of the noble metal tip.

In the case where the bottom surface 520 of the noble metal tip 500 is convex toward the side opposite the discharge surface 510 as shown in section (a) of FIG. 7, the intersection between the vertical line L and the bottom surface 520 is used as an evaluation point P1. Also, the distance between the straight line L2 and the evaluation point P1 measured along the vertical line L is represented by D1.

In the case where the bottom surface 520 of the noble metal tip 500 is concave toward the discharge surface 510 as shown in section (b) of FIG. 7, the intersection between the vertical line L and the bottom surface 520 is used as an evaluation point P2. Also, the distance between the straight line L2 and the evaluation point P2 measured along the vertical line L is represented by D2.

In a simulation result 600 shown in section (c) of FIG. 7, Sample 1 is a noble metal tip whose bottom surface is convex downward (convex toward the side opposite the discharge surface) as shown in section (a) of FIG. 7 and whose distance D1 is 0.08 mm. Sample 2 is a noble metal tip whose bottom surface is convex downward as shown in section (a) of FIG. 7 and whose distance D1 is 0.04 mm. Sample 3 is a noble metal tip whose bottom surface is a flat surface approximately parallel to the discharge surface. Sample 4 is a noble metal tip whose bottom surface is concave upward (concave toward the discharge surface) as shown in section (b) of FIG. 7 and whose distance D2 is 0.04 mm. Sample 5 is a noble metal tip whose bottom surface is concave upward as shown in section (b) of FIG. 7 and whose distance D2 is 0.08 mm.

In the simulation result 600, the vertical axis represents the relative value of the equivalent stress at the evaluation point P1 or P2. Specifically, the vertical axis represents the relative value of the equivalent stress, with the equivalent stress of Sample 3 (noble metal tip 500) whose bottom surface 520 is a flat surface approximately parallel to the discharge surface 510 being used as a reference (relative value: 1).

As is clear from the simulation result 600, in the case where the bottom surface 520 of the noble metal tip 500 is concave toward the discharge surface 510 (upward concave) and the distanced D2 is large, the equivalent stress decreases. Therefore, the separation resistance of the noble metal tip 500 can be improved.

B3. Evaluation Results

[Evaluation 5] Thermal Endurance Test 5

Table 6 shows the result of a test performed for spark plugs having the noble metal tip 350 according to the second embodiment. In Table 6, the item "discharge surface area" indicates the area of the noble metal tip; the item "cross section (suffix)" indicates the half cross section. The suffix "1" of the half cross section indicates the first half cross section 360, and the suffix "2" of the half cross section indicates the second half cross section 370. In the thermal endurance test 5, the noble metal tip 350 satisfies the following requirements.

(1) The first half cross section 360 satisfies (Expression 1) and (Expression 2).

(2) The second half cross section 370 satisfies (Expression 3) and (Expression 4).

(3) The area of the discharge surface 351 is 2.011 $mm^2$.

The thermal endurance test 5 was carried out in the same manner as the thermal endurance test 1 of the first embodiment. Specifically, each sample was mounted to an engine having six cylinders (displacement: 2000 cc), and the engine was operated by repeating an operation cycle of fully opening the throttle, maintaining the engine at a rotational speed of 5000 rpm for one minute, and maintaining the engine in an idling state for one minute. After the actual operation, the degree of progress of oxidation scale at the welding interface 380 between the ground electrode 40 and the noble metal tip 350 of each sample was visually checked. In the thermal endurance test 5, the following evaluation criteria were used:

Excellent "A": oxidation scale observed after engine operation over 175 hours is 25% or less Good "B": oxidation scale observed after engine operation over 150 hours is 25% or less, and oxidation scale observed after engine operation over 175 hours is greater than 25%

TABLE 6

| Sample | Discharge surface area [$mm^2$] | Cross section (suffix) | t | h | Rw | Rt | h/t | Rw/Rt | h3 | Test result |
|---|---|---|---|---|---|---|---|---|---|---|
| Embodiment | 2.011 | 1 | 0.383 | 0.062 | 0.768 | 0.844 | 0.16 | 1.10 | 0.023 | B |
| | | 2 | 0.383 | 0.015 | 0.768 | 0.805 | 0.04 | 1.05 | | |
| Embodiment | 2.011 | 1 | 0.380 | 0.020 | 0.784 | 0.835 | 0.05 | 1.07 | 0.031 | A |
| | | 2 | 0.380 | 0.012 | 0.784 | 0.808 | 0.03 | 1.03 | | |
| Embodiment | 2.011 | 1 | 0.388 | 0.020 | 0.796 | 0.831 | 0.05 | 1.04 | 0.027 | A |
| | | 2 | 0.388 | 0.024 | 0.796 | 0.835 | 0.06 | 1.05 | | |
| Embodiment | 2.011 | 1 | 0.372 | 0.035 | 0.784 | 0.815 | 0.09 | 1.04 | 0.039 | A |
| | | 2 | 0.372 | 0.031 | 0.784 | 0.827 | 0.08 | 1.06 | | |

As is clear from the test results shown in Table 6, in the case where the noble metal tip 350 and the electrode base member 410 are welded together such that the noble metal tip 350 satisfies not only (Expression 1) to (Expression 4) but also (Expression 5) and (Expression 6), the thermal stress acting on the noble metal tip 350 can be restrained, whereby the separation resistance of the noble metal tip 350 can be improved.

According to the above-described spark plug of the second embodiment, on each of the first half cross section 360 and the second half cross section 370, the distance h3 between the straight line L2 and the intersection CA2 between the vertical line L and the bottom surface 352 measured along the direction parallel to the vertical line L satisfies the relations h3>h1 and h3>h2. Accordingly, the welding interface 380 between the noble metal tip 350 and the electrode base member 410 has a portion which is flat or concave toward the discharge surface 351. Therefore, as compared with the case where the welding interface 380 is formed to be convex toward the electrode base member 410, the thermal stress acting on the noble metal tip 350 can be reduced, whereby the separation resistance of the noble metal tip can be improved.

C. Modification

Although the embodiments of the present invention has been described, needless to say, the present invention is not limited to such embodiments, and may be practiced in various modes without departing the scope of the invention. For example, the noble metal tip may be attached to the center electrode instead of the ground electrode, or may be attached to both of the center electrode and the ground electrode.

Also, the cross-sectional shape of the electrode base member is not limited to a rectangular shape, and may be any of various shapes such as a circular shape, an elliptical shape, a triangular shape, and a polygonal shape having n sides (n≥5).

Also, the shape of the noble metal tip is not limited to a circular columnar shape, a triangular columnar shape, and a rectangular columnar shape, and may be any of various columnar shapes such as an elliptical columnar shape and a polygonal columnar shape having n sides (n≥5).

DESCRIPTION OF REFERENCE NUMERALS

10: center electrode
16: seal
17: ceramic resistor
18: seal
19: metal terminal
20: insulator
28: axial hole
30: metallic shell
31: end surface
32: mount screw portion
40: ground electrode
45: engagement portion
50: noble metal tip
50*a*: noble metal tip
51: discharge surface
51*a*: discharge surface
52: bottom surface
52*a*: bottom surface
53: side surface
55: cross section
58: boundary portion
60: first half cross section
61: discharge surface
62: bottom surface
63: side surface
64: end point
65: end point
70: second half cross section
71: discharge surface
72: bottom surface
73: side surface
74: end point
75: end point
80: welding interface
100: spark plug
200: internal combustion engine
210: screw hole
350: noble metal tip
351: discharge surface
352: bottom surface
353: side surface
355: cross section
360: first half cross section
361: discharge surface
362: bottom surface
363: side surface
364: end point
365: end point
370: second half cross section
371: discharge surface
372: bottom surface
373: side surface
374: end point
375: end point
380: welding interface
401: proximal end portion
402: distal end portion
403: side surface
404: side surface
405: side surface
406: side surface
410: electrode base member
420: recess
500: noble metal tip
510: discharge surface
520: bottom surface
600: simulation result

The invention claimed is:

1. A spark plug comprising:

a center electrode;

a ground electrode; and a noble metal tip resistance-welded to at least one of the center electrode and the ground electrode, wherein the noble metal tip has a flat discharge surface, a bottom surface embedded in the electrode to which the noble metal tip is resistance-welded, and a side surface whose width constantly increases from the discharge surface toward the bottom surface, on a predetermined cross section containing a vertical line passing through the centroid of the discharge surface, a maximum thickness along a direction parallel to the vertical line is defined as the maximum thickness t of the noble metal tip, and a straight line which passes through a portion of the bottom surface where the noble metal tip has the maximum thickness and is parallel to the discharge surface is defined as a first straight line, on a first half cross section of two half cross sections formed by dividing the predetermined cross section by the vertical line, a maximum width along a direction orthogonal to the vertical line is defined as the maximum width Rw1 of the noble metal tip, a distance between the first straight line and a position where the noble metal tip has the maximum width, the distance being measured along a direction parallel to the vertical line, is defined as a warpage height h1 of the noble metal tip, and a distance from an intersection between the vertical line and the discharge surface to an end portion of the discharge surface is defined as a width Rt1 of the discharge surface, on a second half cross section of the two half cross sections which differs from the first half cross section, a maximum width along the direction orthogonal to the vertical line is defined as the maximum width Rw2 of the noble metal tip, a distance between the first straight line and a position where the noble metal tip has the maximum width, the distance being measured along the direction parallel to the vertical line, is defined as a warpage height h2 of the noble metal tip, and a distance from an intersection between the vertical line and the discharge surface to an end portion of the discharge surface is defined as a width Rt2 of the discharge surface, relations $h1/t \leq 0.2$ and $Rw1/Rt1 \geq 1.03$ are satisfied, and relations $h2/t \leq 0.2$ and $Rw2/Rt2 \geq 1.03$ are satisfied, on the predetermined cross section containing the vertical line, the noble metal tip has a bottom surface portion which is concave toward the discharge surface, and on each of the first half cross section and the second half cross section, a distance h3 between the first straight line and the intersection between the vertical line and the bottom surface measured along a direction parallel to the vertical line satisfies relations $h3 \geq h1$ and $h3 \geq h2$.

2. A spark plug comprising:

a center electrode;

a ground electrode; and a noble metal tip resistance-welded to at least one of the center electrode and the ground electrode, wherein the noble metal tip has a flat discharge surface, a bottom surface embedded in the electrode to which the noble metal tip is resistance-welded, and a side surface whose width constantly increases from the discharge surface toward the bottom surface, on a predetermined cross section containing a vertical line passing through the centroid of the discharge surface, a maximum thickness along a direction parallel to the vertical line is defined as the maximum thickness t of the noble metal tip, and a straight line which passes through a portion of the bottom surface where the noble metal tip has the maximum thickness and is parallel to the discharge surface is defined as a first straight line, on a first half cross section of two half cross sections formed by dividing the predetermined cross section by the vertical line, a maximum width along a direction orthogonal to the vertical line is defined as the maximum width Rw1 of the noble metal tip, a distance between the first straight line and a position where the noble metal tip has the maximum width, the distance being measured along a direction parallel to the vertical line, is defined as a warpage height h1 of the noble metal tip, and a distance from an intersection between the vertical line and the discharge surface to an end portion of the discharge surface is defined as a width Rt1 of the discharge surface, on a second half cross section of the two half cross sections which differs from the first half cross section, a maximum width along the direction orthogonal to the vertical line is defined as the maximum width Rw2 of the noble metal tip, a distance between the first straight line and a position where the noble metal tip has the maximum width, the distance being measured along the direction parallel to the vertical line, is defined as a warpage height h2 of the noble metal tip, and a distance from an intersection between the vertical line and the discharge surface to an end portion of the discharge surface is defined as a width Rt2 of the discharge surface, relations $h1/t \leq 0.2$ and $Rw1/Rt1 \geq 1.03$ are satisfied, and relations $h2/t \leq 0.2$ and $Rw2/Rt2 \geq 1.03$ are satisfied, and on the predetermined cross section, the bottom surface is convex toward the side opposite the discharge surface.

3. The spark plug according to claim 1, wherein the discharge surface has an area of 0.79 $mm^2$ to 3.14 $mm^2$.

4. The spark plug according to claim 1, wherein the noble metal tip contains a Pt—Ni alloy; and the electrode to which the noble metal tip is welded contains a heat resisting nickel alloy containing Cr and Fe.

5. The spark plug according to claim 2, wherein the discharge surface has an area of 0.79 $mm^2$ to 3.14 $mm^2$.

6. The spark plug according to claim 2, wherein the noble metal tip contains a Pt—Ni alloy; and the electrode to which the noble metal tip is welded contains a heat resisting nickel alloy containing Cr and Fe.

7. The spark plug according to claim 3, wherein the noble metal tip contains a Pt—Ni alloy; and the electrode to which the noble metal tip is welded contains a heat resisting nickel alloy containing Cr and Fe.

8. The spark plug according to claim 1, wherein the bottom surface of the noble metal tip is embedded into the electrode in such a manner that a surface of the electrode extends substantially parallel to the side surface of the noble metal tip.

9. The spark plug according to claim 2, wherein the bottom surface of the noble metal tip is embedded into the electrode in such a manner that a surface of the electrode extends substantially parallel to the side surface of the noble metal tip.

* * * * *